US006924011B2

(12) United States Patent
Van Aert et al.

(10) Patent No.: US 6,924,011 B2
(45) Date of Patent: Aug. 2, 2005

(54) INK JET RECORDING MATERIAL

(75) Inventors: Huub Van Aert, Pulderbos (BE); Stefaan Lingier, Assenede (BE)

(73) Assignee: AGFA Gevaert, Mortsel (BE)

( * ) Notice: Subject to any disclaimer, the term of this patent is extended or adjusted under 35 U.S.C. 154(b) by 35 days.

(21) Appl. No.: 10/440,907

(22) Filed: May 19, 2003

(65) Prior Publication Data

US 2004/0043163 A1 Mar. 4, 2004

Related U.S. Application Data

(60) Provisional application No. 60/409,777, filed on Sep. 11, 2002.

(30) Foreign Application Priority Data

Aug. 27, 2002 (EP) ..... 02102221

(51) Int. Cl.[7] ..... B41M 5/40

(52) U.S. Cl. ..... 428/32.32; 428/32.34; 428/32.38

(58) Field of Search ..... 428/32.32, 32.34, 428/32.38

(56) References Cited

U.S. PATENT DOCUMENTS 5,439,739 A * 8/1995 Furukawa et al. ..... 428/32.23

FOREIGN PATENT DOCUMENTS

| | | |
|---|---|---|
| EP | 0 415 849 | 6/1991 |
| EP | 0 627 324 | 7/1994 |

OTHER PUBLICATIONS

Patent Abstracts of Japan, 2000043405, published Feb. 15, 1998.

European Search Report, EP 02 10 2221, published Jan. 17, 2003.

Chem Abstrasts Service, Database accession No. 134:245271.

* cited by examiner

*Primary Examiner*—B. Shewareged

(74) *Attorney, Agent, or Firm*—Joseph T. Guy; Nexsen Pruet LLC

(57) ABSTRACT

An improved ink jet recording material is disclosed comprising a support and an ink receiving layer. This layer contains a pigment and a polymeric binder comprising a structural unit derived from a monomer represented by following formula (I):

formula (I)

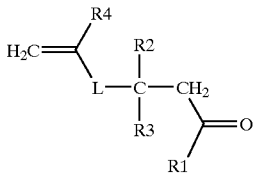

wherein,

R1 is alkyl, R2 is alkyl or aryl, R3 is hydrogen, alkyl or aryl, L is a linking unit selected from CO—NH, CO—O, and CO, and R4 is hydrogen or alkyl.

The material is improved for mechanical strength. The finished ink jet image shows high color densities and high gloss without the occurence of cracking.

18 Claims, No Drawings

INK JET RECORDING MATERIAL

This application claims benefit of application Ser. No. 60/409,777 filed on Sep. 11, 2002.

FIELD OF THE INVENTION

The present invention relates to an improved ink jet recording material.

BACKGROUND OF THE INVENTION

In the majority of applications printing proceeds by pressure contact of an ink-loaden printing form with an ink-receiving material which is usually plain paper. The most frequently used impact printing technique is known as lithographic printing based on the selective acceptance of oleophilic ink on a suitable receptor. In recent times however so-called non-impact printing systems have replaced classical pressure-contact printing to some extent for specific applications. A survey is given e.g. in the book "Principles of Non Impact Printing" by Jerome L. Johnson (1986), Palatino Press, Irvine, Calif. 92715, USA.

Among non-impact printing techniques ink jet printing has become a popular technique because of its simplicity, convenience and low cost. Especially in those instances where a limited edition of the printed matter is needed ink jet printing has become a technology of choice. A recent survey on progress and trends in ink jet printing technology is given by Hue P. Le in *Journal of Imaging Science and Technology* Vol. 42 (1), January/February 1998.

In ink jet printing tiny drops of ink fluid are projected directly onto an ink receptor surface without physical contact between the printing device and the receptor. The printing device stores the printing data electronically and controls a mechanism for ejecting the drops image-wise. Printing is accomplished by moving the print head across the paper or vice versa. Early patents on ink jet printers include U.S. Pat. Nos. 3,739,393, 3,805,273 and 3,891,121. The jetting of the ink droplets can be performed in several different ways. In a first type of process a continuous droplet stream is created by applying a pressure wave pattern. This process is known as continuous ink jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink jet printing several jets are deflected to a different degree and thus record the image (multideflection system). According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method"), or by means of discrete thermal pushes (so-called "bubble jet" method, or "thermal jet" method).

Ink compositions for ink jet typically include following ingredients: dyes or pigments, water and/or organic solvents, humectants such as glycols, detergents, thickeners, polymeric binders, preservatives, etc.. It will be readily understood that the optimal composition of such an ink is dependent on the ink jetting method used and on the nature of the substrate to be printed. The ink compositions can be roughly divided in:

water based; the drying mechanism involves absorption, penetration and evaporation;

oil based; the drying involves absorption and penetration;

solvent based; the drying mechanism involves primarely evaporation;

hot melt or phase change: the ink vehicle is liquid at the ejection temperature but solid at room temperature; drying is replaced by solidification;

UV-curable; drying is replaced by polymerization.

It is known that the ink-receiving layers in ink-jet recording elements must meet different stringent requirements:

The ink-receiving layer should have a high ink absorbing capacity, so that the dots will not flow out and will not be expanded more than is necessary to obtain a high optical density.

The ink-receiving layer should have a high ink absorbing speed (short ink drying time) so that the ink droplets will not feather if smeared immediately after applying.

The ink dots that are applied to the ink-receiving layer should be substantially round in shape and smooth at their peripheries. The dot diameter must be constant and accurately controlled.

The receiving layer must be readily wetted so that there is no "puddling", i.e. coalescence of adjacent ink dots, and an earlier absorbed ink drop should not show any "bleeding", i.e. overlap with neighbouring or later placed dots.

Transparent ink-jet recording elements must have a low haze-value and be excellent in transmittance properties.

After being printed the image must have a good resistance regarding water-fastness, light-fastness, and good endurance under severe conditions of temperature and humidity.

The ink jet recording element may not show any curl or sticky behaviour if stacked before or after being printed.

The ink jet recording element must be able to move smoothly through different types of printers.

All these properties are often in a relation of trade-off. It is difficult to satisfy them all at the same time.

In order to obtain images showing high gloss, high color densities and fast drying it is desirable that the ink receiving has a relative high coating weight and a high pigment/binder ratio. However, such a high pigment/binder ratio tends to deteriorate the mechanical strength of the ink receiving layer, in particular when a flexible support is used, which is often visible as microcracks. It is strongly desired to find measures to avoid this cracking while retaining the other good image properties.

SUMMARY OF THE INVENTION

It is the object of the present invention to provide an ink jet receiving medium wherein the finished image shows high gloss and high densities in the absence of cracking.

The above-mentioned advantageous effects are realised by providing an ink jet recording material comprising a support and at least one ink receiving layer containing a pigment and a polymeric binder, wherein said polymeric binder contains a structural unit derived from a monomer represented by following formula (I):

formula (I)

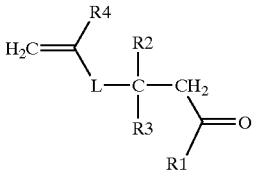

wherein R1 is alkyl, R2 is alkyl or aryl, R3 is hydrogen, alkyl or aryl, L is a linking unit selected from CO—NH, CO—O, and CO, and R4 is is hydrogen or alkyl.

In a preferred embodiment R1, R2 and R3 are methyl, L is CO—NH, and R4 is hydrogen or methyl, so that the monomer is diacetone (meth)acrylamide.

Preferably, the polymeric binder is a copolymer of the monomer according to formula (I) and other types of monomer. A most preferred polymeric binder is a copolymer of vinyl alcohol, vinyl acetate, and diacetone acrylamide.

Further advantages and embodiments of the present invention will become apparent from the following description.

DETAILED DESCRIPTION OF THE INVENTION

The different layers and particular ingredients of the ink recording medium according to the present invention will now be explained in detail.

—The Support

The support for use in the present invention can be chosen from paper type and polymeric type supports well-known from photographic technology. Paper types include plain paper, cast coated paper, polyethylene coated paper and polypropylene coated paper. Polymeric supports include cellulose acetate propionate or cellulose acetate butyrate, polyesters such as polyethylene terephthalate and polyethylene naphthalate, polyamides, polycarbonates, polyimides, polyolefins, poly(vinylacetals), polyethers and polysulfonamides. Other examples of useful high-quality polymeric supports for the present invention include opaque white polyesters and extrusion blends of polyethylene terephthalate and polypropylene. Polyester film supports and especially polyethylene terephthalate are preferred because of their excellent properties of dimensional stability. When such a polyester is used as the support material, a subbing layer may be employed to improve the bonding of the ink-receiving layer to the support. Useful subbing layers for this purpose are well known in the photographic art and include, for example, polymers of vinylidene chloride such as vinylidene chloride/acrylonitrile/acrylic acid terpolymers or vinylidene chloride/methyl/acrylate/itaconic acid terpolymers.

—The Ink Receiving Layer

It is the gist of the present invention that the porous ink receiving layer contains, apart from a pigment, a polymeric binder having a structural unit derived from a monomer as defined by formula (I).

Useful monomers in connection with the present invention are included in following list:

Diacetone acrylamide, CASRN. 2873-97-4:

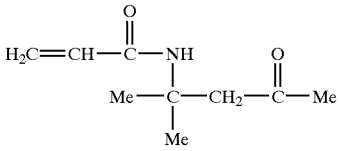

4-methyl-1-octene-3,6-dione, CASRN 172946-87-1:

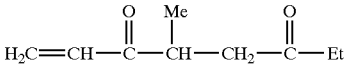

Diacetone methacrylamide, CASRN 22029-67-0:

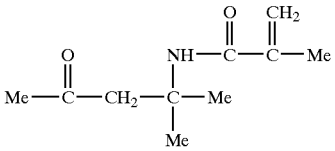

2-methyl-2-propenoic acid, 1,1-dimethyl-3-oxobutyl ester, CASRN 93940-09-1:

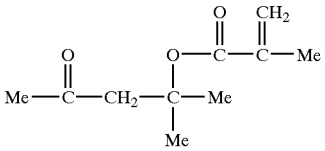

3-Oxo-1,1-dimethylbutyl acrylate, CASRN155844-84-1:

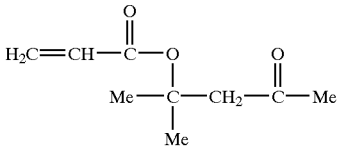

N-(1-Methyl-1-ethyl-3-oxopentyl)acrylamide, CASRN10193-02-9:

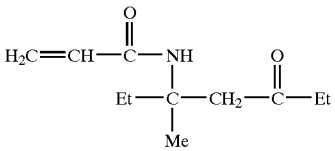

Diacetophenoneacrylamide, CASRN20282-44-4

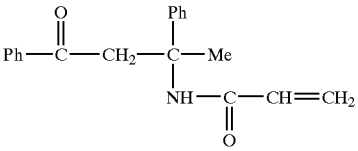

N-(1-Isopropyl-1,5-dimethyl-3-oxohexyl)acrylamide, CASRN40660-71-7

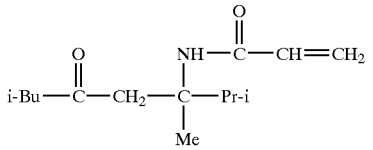

N-[1,5-Dimethyl-1-(2-methyl-1-propyl)-3-oxohexyl] acrylamide, CASRN10193-03-0

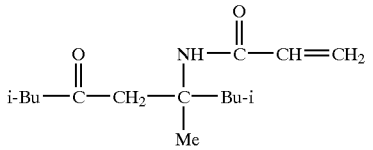

N-(1,3-Dicyclohexyl-1-methyl-3-oxopropyl)acrylamide, CASRN40660-70-6,

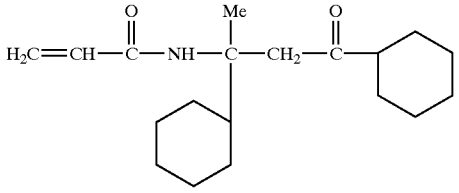

The advantage of such comonomers is that they can give self-crosslinking, enhancement of crosslinking of a separate crosslinker, or its functional group can give an interaction with the inorganic pigment. As compared to similar polymer binders in which this functional monomer is not incorporated clearly an improvement of mechanical strength and, less cracking of the pigmented layer is observed. Besides the improvement of cracking, a very high gloss and high printed densities can be obtained.

The polymeric binder used in accordance with the present invention may be mixed with conventional binders well known in the art.

Another essential ingredient of the ink receiving layer is a pigment.

The pigment used in the ink receiving layer is preferably an inorganic pigment, which can be chosen from neutral, anionic and cationic pigment types. Useful pigments include e.g. silica, talc, clay, hydrotalcite, kaolin, diatomaceous earth, calcium carbonate, magnesium carbonate, basic magnesium carbonate, aluminosilicate, aluminum trihydroxide, aluminum oxide (alumina), titanium oxide, zinc oxide, barium sulfate, calcium sulfate, zinc sulfide, satin white, alumina hydrate such as boehmite, zirconium oxide or mixed oxides.

Preferably, the pigment is a cationic type pigment selected from alumina hydrates, aluminum oxides, aluminum hydroxides, aluminum silicates, and cationically modified silicas.

A preferred type of alumina hydrate is crystalline boehmite, or γ-AlO(OH). Useful types of boehmite include, in powder form, DISPERAL, DISPERAL HP14 and DISPERAL 40 from Sasol, MARTOXIN VPP2000-2 and GL-3 from Martinswerk GmbH.; liquid boehmite alumina systems, e.g. DISPAL 23N4-20, DISPAL 14N-25, DISPERAL AL25 from Sasol. Patents on alumina hydrate include EP 500021, EP 634286, U.S. Pat. No. 5,624,428, EP 742108, U.S. Pat. No. 6,238,047, EP 622244, EP 810101, etc..

Useful cationic aluminum oxide (alumina) types include $\alpha$-$Al_2O_3$ types, such as NORTON E700, available from Saint-Gobain Ceramics & Plastics, Inc, and $\gamma$-$Al_2O_3$ types, such as ALUMINUM OXID C from Degussa; other aluminum oxide grades, such as BAIKALOX CR15 and CR30 from Baikowski Chemie; DURALOX grades and MEDIALOX grades from Baikowski Chemie, BAIKALOX CR80, CR140, CR125, B105CR from Baikowski Chemie; CAB-O-SPERSE PG003 trademark from Cabot, CATALOX GRADES and CATAPAL GRADES from from Sasol, such as PLURALOX HP14/150; colloidal $Al_2O_3$ types, such as ALUMINASOL 100; ALUMINASOL 200, ALUMINASOL 220, ALUMINASOL 300, and ALUMINASOL 520 trademarks from Nissan Chemical Industries or NALCO 8676 trademark from ONDEO Nalco. Other useful cationic inorganic pigments include aluminum trihydroxides such as Bayerite, or $\alpha$-$Al(OH)_3$, such as PLURAL BT, available from Sasol, and Gibbsite, or $\gamma$-$Al(OH)_3$, such as MARTINAL grades from Martinswerk GmbH, MARTIFIN grades, such as MARTIFIN OL104, MARTIFIN OL 107 and MARTIFIN OL111 from Martinswerk GmbH MICRAL grades, such as MICRAL 1440, MICRAL 1500; MICRAL 632; MICRAL 855; MICRAL 916; MICRAL 932; MICRAL 932CM; MICRAL 9400 from JM Huber company; HIGILITE grades, e.g. HIGILITE H42 or HIGILITE H43M from Showa Denka K. K., HYDRAL COATES grades from Alcoa Co., such as HYDRAL COAT 2, 5, and 7, HYDRAL PGA and HYDRAL 710.

Another useful type of cationic pigment is zirconium oxide such as NALCO OOSS008 trademark of ONDEO Nalco, acetate stabilized $ZrO_2$, ZR20/20, ZR50/20, ZR100/20 and ZRYS4 trademarks from Nyacol Nano Technologies.

Useful mixed oxides are SIRAL grades from Sasol, colloidal metal oxides from Nalco such as Nalco 1056, Nalco TX10496, Nalco TX11678. Another preferred type of inorganic pigment is silica which can be used as such in its anionic form or after cationic modification. Silica as pigment in ink receiving elements is disclosed in numerous old and recent patents, e.g. U.S. Pat. Nos. 4,892,591, 4,902,568, EP 373573, EP 423829, EP 487350, EP 493100, EP 514633, etc.. The silica can be chosen from different types, such as crystalline silica, amorphous silica, precipitated silica, fumed silica, silica gel, spherical and non-spherical silica. The silica may contain minor amounts of metal oxides from the group Al, Zr, Ti. Useful types include AEROSIL OX50 (BET surface area 50±15 $m^2/g$, average primary particle size 40 nm, $SiO_2$ content>99.8%, $Al_2O_3$ content<0.08%), AEROSIL MOX170 (BET surface area 170 $g/m^2$, average primary particle size 15 nm, $SiO_2$ content>98.3%, $Al_2O_3$ content 0.3–1.3%), AEROSIL MOX80 (BET surface area 80±20 $g/m^2$, average primary particle size 30 nm, $SiO_2$ content>98.3%, $Al_2O_3$ content 0.3–1.3%), or other hydrophilic AEROSIL grades available from Degussa-Hüls AG, which may give aqueous dispersions with a small average particle size (<500 nm).

Cationically modified silica can be prepared by following methods, without meaning to be limitative:

(1) subjecting silica to a surface treatment with an inorganic cationic compound such as particular metal oxides and oxyhydroxides, e.g. aluminum oxides, and alumina hydrates such as boehmite and pseudo-boehmite; a useful cationic inorganic compound to modify silica is pseudo-boehmite. Pseudo-boehmite is also called boehmite gel and is fine particulate alumina hydrate having a needle form.

The composition thereof is generally represented by $Al_2O_3.1.5–2\ H_2O$ and differs from that of crystalline boehmite;

(2) by subjecting silica to a surface treatment with an organic compound having both an amino group or quaternary ammonium group thereof or a quaternary phosphonium group, and a functional group having reactivity to a silanol group on the surface of silica, such as aminoalkoxysilane or aminoalkyl glycidyl ether or isopropanol amine;

(3) by polymerisation of a cationic or amino functional monomer in the presence of a silica.

In an alternative embodiment the pigment may be chosen from organic particles such as polystyrene, polymethyl methacrylate, silicones, melamine-formaldehyde condensation polymers, urea-formaldehyde condensation polymers, polyesters and polyamides. Mixtures of inorganic and organic pigments can be used. However, most preferably the pigment is an inorganic pigment.

The pigment must be present in a sufficient coverage in order to render the ink receiving layer sufficiently porous.

For obtaining glossy ink receiving layers the particle size of the pigment should preferably be smaller than 500 nm. In order to obtain a porous glossy layer which can serve as an ink receiving layer for fast ink uptake the pigment/binder ratio should be at least 4. Only at these high ratios the binder is no longer able to fill up all pores and voids created by the pigments in the coating. To achieve a sufficient porosity of the coating for fast ink uptake the pore volume of these highly pigmented coatings should be higher than 0.1 ml/g of coated solids. This pore volume can be measured by gas adsorption (nitrogen) or by mercury diffusion.

The ink receiving layer be may just a single layer but, alternatively, it may be composed of a double layer or even of a multiple layer assemblage. In the latter cases the polymeric binder and/or the pigment may be present in one of the layers, or in several of the layers or in all layers.

Apart from the essential ingredients described above a cationic substance acting as mordant may be present in the ink receiving layer. Such substances increase the capacity of the layer for fixing and holding the dye of the ink droplets. A particularly suited compound is a poly (diallyldimethylammonium chloride) or, in short, a poly (DADMAC). These compounds are commercially available from several companies, e.g. Aldrich, Nalco, CIBA, Nitto Boseki Co., Clariant, BASF and EKA Chemicals.

Other useful cationic compounds include DADMAC copolymers such as copolymers with acrylamide, e.g NALCO 1470 trade mark of ONDEO Nalco or PAS-J-81, trademark of Nitto Boseki Co., such as copolymers of DADMAC with acrylates, such as Nalco 8190, trademark of ONDEO Nalco; copolymers of DADMAC with $SO_2$, such as PAS-A-1 or PAS-92, trademarks of Nitto Boseki Co., copolymer of DADMAC with maleic acid, e.g. PAS-410, trademark of Nitto Boseki Co., copolymer of DADMAC with diallyl(3-chloro-2-hydroxypropyl)amine hydrochloride, e.g. PAS-880, trademark of Nitto Boseki Co., dimethylamine-epichlorohydrine copolymers, e.g. Nalco 7135, trademark of ONDEO Nalco or POLYFIX 700, trade name of Showa High Polymer Co.; other POLYFIX grades which could be used are POLYFIX 601, POLYFIX 301, POLYFIX 301A, POLYFIX 250WS, and POLYFIX 3000; NEOFIX E-117, trade name of Nicca Chemical Co., a polyoxyalkylene polyamine dicyanodiamine, and REDIFLOC 4150, trade name of EKA Chemicals, a polyamine; MADAME (methacrylatedimethylaminoethyl=dimethylaminoethyl methacrylate) or MADQUAT (methacryloxyethyltrimethylammonium chloride) modified polymers, e.g. ROHAGIT KL280, ROHAGIT 210, ROHAGIT SL144, PLEX 4739L, PLEX 3073 from Röhm, DIAFLOC KP155 and other DIAFLOC products from Diafloc Co., and BMB 1305 and other BMB products from EKA chemicals; cationic epichlorohydrin adducts such as POLYCUP 171 and POLYCUP 172, trade names from Hercules Co.; from Cytec industries: CYPRO products, e.g. CYPRO 514/515/516, SUPERFLOC 507/521/567; cationic acrylic polymers, such as ALCOSTAT 567, trademark of CIBA, cationic cellulose derivatives such as CELQUAT L-200, H-100, SC-240C, SC-230M, trade names of Starch & Chemical Co., and QUATRISOFT LM200, UCARE polymers JR125, JR400, LR400, JR3OM, LR3OM and UCARE polymer LK; fixing agents from Chukyo Europe: PALSET JK-512, PALSET JK512L, PALSET JK-182, PALSET JK-220, WSC-173, WSC-173L, PALSET JK-320, PALSET JK-320L and PALSET JK-350; polyethyleneimine and copolymers, e.g. LUPASOL, trade name of BASF AG; triethanolamine-titanium-chelate, e.g. TYZOR, trade name of Du Pont Co.; copolymers of vinylpyrrolidone such as VIVIPRINT 111, trade name of ISP, a methacrylamido propyl dimethylamine copolymer; with dimethylaminoethylmethacrylate such as COPOLYMER 845 and COPOLYMER 937, trade names of ISP; with vinylimidazole, e.g. LUVIQUAT CARE, LUVITEC 73W, LUVITEC VPI55 K18P, LUVITEC VP155 K72W, LUVIQUAT FC905, LUVIQUAT FC550, LUVIQUAT HM522, and SOKALAN HP56, all trade names of BASF AG; polyamidoamines, e.g. RETAMINOL and NADAVIN, trade marks of Bayer AG; phosphonium compounds such as disclosed in EP 609930 and other cationic polymers such as NEOFIX RD-5, trademark of Nicca Chemical Co.

The ink receiving layer, and an optional auxiliary layer, such as a backing layer for anti-curl purposes, may further contain well-known conventional ingredients, such as surfactants serving as coating aids, hardening agents, plasticizers, whitening agents and matting agents.

Surfactants may be incorporated in the layers of the recording element of the present invention. They can be any of the cationic, anionic, amphoteric, and non-ionic ones as described in JP-A 62-280068 (1987). Examples of the surfactants are N-alkylamino acid salts, alkylether carboxylic acid salts, acylated peptides, alkylsulfonic acid salts, alkylbenzene and alkylnaphthalene sulfonic acid salts, sulfosuccinic acid salts, α-olefin sulfonic acid salts, N-acylsulfonic acid salts, sulfonated oils, alkylsulfonic acid salts, alkylether sulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed polyoxyethylene ethers, blocked polymers having polyoxypropylene, polyoxyethylene polyoxypropylalkylethers, polyoxyethyleneether of glycolesters, polyoxyethyleneether of sorbitanesters, polyoxyethyleneether of sorbitolesters, polyethyleneglycol aliphatic acid esters, glycerol esters, sorbitane esters, propyleneglycol esters, sugaresters, fluoro $C_2$–$C_{10}$ alkylcarboxylic acids, disodium N-perfluorooctanesulfonyl glutamate, sodium 3-(fluoro-$C_6$–$C_{11}$-alkyloxy)-1–$C_3$-$C_4$ alkyl sulfonates, sodium 3-(ω-fluoro-$C_6$–$C_8$-alkanoyl-N-ethylamino)-1-propane sulfonates, N-[3-(perfluorooctanesulfonamide)-propyl]-N, N-dimethyl-N-carboxymethlene ammonium betaine, fluoro-$C_{11}$–$C_{20}$ alkylcarboxylic acids, perfluoro-$C_7$–$C_{13}$-alkylcarboxylic acids, perfluorooctane sulfonic acid diethanolamide, Li, K and Na perfluoro-$C_4$–$C_{12}$-alkyl sulfonates, N-propyl-N-(2-hydroxyethyl)perfluorooctane sulfonamide, perfluoro-$C_6$–$C_{10}$-alkylsulfonamide-propylsulfonyl-glycinates, bis-(N-perfluorooctylsulfonyl-N-ethanolaminoethyl)phosphonate, mono-perfluoro $C_6$–$C_{16}$ alkyl-ethyl phosphonates, and perfluoroalkylbetaine.

Useful cationic surfactants include N-alkyl dimethyl ammonium chloride, palmityl trimethyl ammonium chloride, dodecyldimethylamine, tetradecyldimethylamine, ethoxylated alkyl guanidine-amine complex, oleamine hydroxypropyl bistrimonium chloride, oleyl imidazoline, stearyl imidazoline, cocamine acetate, palmitamine, dihydroxyethylcocamine, cocotrimonium chloride, alkyl polyglycolether ammonium sulphate, ethoxylated oleamine, lauryl pyridinium chloride, N-oleyl-1,3-diaminopropane, stearamidopropyl dimethylamine lactate, coconut fatty amide, oleyl hydroxyethyl imidazoline, isostearyl ethylimidonium ethosulphate, lauramidopropyl PEG-dimoniumchloride phosphate, palmityl trimethylammonium chloride, and cetyltrimethylammonium bromide.

Especially useful are the fluorocarbon surfactants as described in e.g. U.S. Pat. No. 4,781,985, having a structure of: $F(CF_2)_{4-9}CH_2CH_2SCH_2CH_2N^+R_3X^-$ wherein R is a hydrogen or an alkyl group; and in U.S. Pat. No. 5,084,340, having a structure of: $CF_3(CF_2)_mCH_2CH_2O(CH_2CH_2O)_nR$ wherein m=2 to 10; n=1 to 18; R is hydrogen or an alkyl group of 1 to 10 carbon atoms. These surfactants are commercially available from DuPont and 3M. The concentration of the surfactant component in the ink-receiving layer is typically in the range of 0.1 to 2%, preferably in the range of 0.4 to 1.5% and is most preferably 0.75% by weight based on the total dry weight of the layer.

A separate crosslinking agent may be incorporated in the ink receiving layer and/or in an auxiliary layer. There are a vast number of known crosslinking agents—also known as hardening agents—that will function to crosslink film forming binders. Hardening agents can be used individually or in combination and in free or in blocked form. A great many hardeners, useful for the present invention, are known, including formaldehyde and free dialdehydes, such as succinaldehyde and glutaraldehyde, blocked dialdehydes, active esters, sulfonate esters, active halogen compounds, isocyanate or blocked isocyanates, polyfunctional isocyanates, melamine derivatives, s-triazines and diazines, epoxides, active olefins having two or more active bonds, carbodiimides, zirconium complexes, e.g. BACOTE 20, ZIRMEL 1000 or zirconium acetate, trademarks of MEL Chemicals, titanium complexes, such as TYZOR grades from DuPont, isoxazolium salts subsituted in the 3-position, esters of 2-alkoxy-N-carboxy-dihydroquinoline, N-carbamoylpyridinium salts, hardeners of mixed function, such as halogen-substituted aldehyde acids (e.g. mucochloric and mucobromic acids), onium substituted acroleins and vinyl sulfones and polymeric hardeners, such as dialdehyde starches and copoly(acroleinmethacrylic acid), and oxazoline functional polymers, e.g. EPOCROS WS-500, and EPOCROS K-1000 series, and maleic anhydride copolymers, e.g. GANTREZ AN119 In the practice of this invention boric acid is a preferred crosslinker.

The ink-receiving layer and the optional auxiliary layer(s) may also comprise a plasticizer such as ethylene glycol, diethylene glycol, propylene glycol, polyethylene glycol, glycerol monomethylether, glycerol monochlorohydrin, ethylene carbonate, propylene carbonate, urea phosphate, triphenylphosphate, glycerolmonostearate, propylene glycol monostearate, tetramethylene sulfone, n-methyl-2-pyrrolidone, n-vinyl-2-pyrrolidone.

The different layers can be coated onto support by any conventional coating technique, such as dip coating, knife coating, extrusion coating, spin coating, slide hopper coating and curtain coating.

The present invention will now be illustrated by the following examples without however being limited thereto.

EXAMPLES

Example 1

The following polymeric binders were used.

Reference binder for the comparative sample: a cationic polyvinylalcohol GOSHEFIMER K210, trade mark of Nippon Goshei, 13-1, Muroyama 2-chome, Ikaraki, Osaka 567-0052, Japan. Gohsefimer K210 has a degree of hydrolysis between 85.5–88.0 mol % and a viscosity of a 4% aqueous sololution of 18.0–22.0 mPas.

Binder for the invention sample: D700, trade mark of Unitika LTD, 4-1-3 Kyutara-Machi Chuo-Ku, Osaka, 541-8566 Japan; this is a modified polyvinyl alcohol comonomer comprising vinyl alcohol, vinyl acetate and diacetone acrylamide monomers. D700 has the appearance of cream-colored granules. A 4% aqueous solution has a viscosity of 20–30 mPa.s at 20° C. using a Brookfield viscometer.

Coating liquids for forming ink recording layers were prepared by adding 30 parts by solid weight of a 40% aqueous solution of alumina (CAB-O-SPERSE PG003 provided by Cabot Corp.) together with 1.3 parts by weight of a 4% aqueous solution of boric acid to 7.4 parts by weight of a 10% aqueous solution of polyvinyl alcohol GOSHEFIMER K210 provided by Nippon Goshei) for the comparative sample, or to 6.3 parts by weight of a 10% aqueous solution of the modified polyvinyl alcohol D700 for the invention sample.

The coating solution was coated on a subbed PET sheet (100 μm) using a wire bar to form an ink receiving layer having a dry weight of 31.5 g/m$^2$, and dried at 40° C. The specular gloss was measured at 60° and the cracking of the coating was visually evaluated.

Color patches containing primary and secondary colors were printed on the coated samples by means of a Epson Stylus Photo 870 (trademark: Seiko Epson Corp.). By means of these color patches the drying time and color density can be measured. The drying time corresponds to the time the printed patch of 100% cyan cannot be smeared out with the fingers. The test results are shown in table 1.

TABLE 1

| Sample | Gloss | Cracking | Drying time (seconds) | Density yellow | Denstiy magenta | Density Cyan | Density Black |
|---|---|---|---|---|---|---|---|
| Comp. | 44.9 | No | 11 | 1.30 | 1.52 | 1.97 | 1.82 |
| Invent. | 74.2 | No | 12 | 1.41 | 1.71 | 2.18 | 1.95 |

As can be seen, the coated and printed invention sample with compound D700 as binder shows a higher gloss and higer color densities without imparting negatively the physical properties as drying time and cracking.

Example 2

A polymeric binder used in accordance with the present invention was prepared by a semi-continuous emulsion copolymerization of butyl acrylate and diacetone acrylamide, according to the folowing procedure.

10.8 g of a cationic surfactant cetyltrimethylammonium bromide was dissolved in 1412 g of water in a 2 l jacketed reactor with nitrogen flow and stirred at 250 rpm. Subsequently the reactor was heated to 85° C. 37.8 g of butyl acrylate and 16.2 g of diacetone acrylamide were added to the reactor. The emulsion was stirred for 5 minutes. Subsequently the reaction was initiated by addition of a mixture of 0.54 g of a 30% aqueous $H_2O_2$ solution and 0.81 gram of ascorbic acid. After nucleation of the latex 214.2 g of butyl acrylate and 91.8 g of diacetone acrylamide were pumped into the reactor within a time interval of 90 minutes. Simultaneously however in a time interval of 110 minutes an initator solution containing a mixture of 3.06 g of a 30% aqueous $H_2O_2$ solution and 0.81 g of ascorbic acid was dosed to the reactor.

When all ingredients were added the reaction was allowed to continue for 30 minutes, after which the residual monomer was removed by vacuum destillation during 60 minutes. The reactor was cooled to room temperature and subsequently the latex was filtered over coarse filtration paper. The emulsion polymerization resulted in a latex having an average particle size of 81 nm, a pH of 2.31, a viscosity of 4.3 mPa.s and a solids content of 21.0 weight %.

An ink jet recording medium was prepared by the same procedure as for the comparative sample of example 1 with the exception that in the preparation for the coating liquid the polyvinyl alcohol was replaced by 3.0 parts of a 21% aqueous emulsion of the above described polymeric binder containing butyl acrylate and diacetone acrylamide monomers.

The samples were coated and printed on the same way as in comparative example 1. The color bleeding was visually evaluated according to an arbitrary scale with ratings 1 to 5, with 5 being best without any color bleeding. The results are shown in table 2.

TABLE 2

| Sample | Gloss | Bleeding |
|---|---|---|
| Comp. Ex. 1 | 44.9 | 2 |
| Invent. Ex. 2 | 56.8 | 3 |

As can be seen, the coated and printed invention sample described in this example 2 shows a higher gloss and lower color bleeding than the comparative sample.

Having described in detail preferred embodiments of the current invention, it will now be apparent to those skilled in the art that numerous modifications can be made therein without departing from the scope of the invention as defined in the appending claims.

What is claimed is:

1. An ink jet recording material comprising a support and at least one ink receiving layer containing a pigment and a polymeric binder, wherein said polymeric binder contains a structural unit derived from a monomer represented by following formula (I):

formula (I)

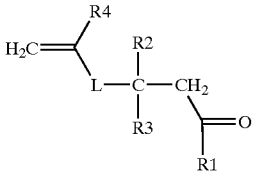

wherein R1 is alkyl, R2 is alkyl or aryl, R3 is hydrogen, alkyl or aryl, L is a linking unit selected from CO—NH, CO—O, and CO, and R4 is hydrogen or alkyl wherein the ratio of said pigment over said polymeric binder has a value of at least 4.

2. An ink jet recording material according to claim 1 wherein said polymeric binder is a copolymer of the monomer represented by formula (I) and at least one other monomer selected from the group consisting of vinyl alcohol, vinyl amine, allyl amine, acrylates, methacrylates, acrylamides, methacrylamides, allyl ethers, vinyl ethers, vinyl esters, styrene and styrene derivatives, vinyl acetamide, and vinyl formamide.

3. An ink jet recording material according to claim 1 wherein said monomer according to formula (I) is diacetone acrylamide or diacetone methacrylamide, whereby R1, R2, and R3 are methyl, L is CO—NH, and R4 is hydrogen or methyl respectively.

4. An ink jet recording material according to claim 1 wherein said polymeric binder is a copolymer of vinyl alcohol, vinyl acetate and diacetone acrylamide.

5. An ink jet recording material according to claim 1 wherein said polymeric binder is a copolymer of n-butylacrylate and diacetone acrylamide.

6. An ink jet recording material according to claim 1 wherein said pigment is an inorganic pigment.

7. An ink jet recording material according to claim 6 wherein said inorganic pigment is chosen from the group consisting of aluminum oxide, boehmite, pseudo-boehmite, gibbsite, bayerite, aluminum hydroxide, silica, clay, calcium carbonate, zirconia, and mixed inorganic oxies/hydroxides.

8. An ink jet recording material according to claim 1 wherein said pigment is smaller than 500 nm.

9. An ink jet recording material according to claim 6 wherein said pigment is smaller than 500 nm.

10. An ink jet recording material comprising a support and at least one ink receiving layer containing a pigment and a polymeric binder, wherein said polymeric binder contains a structural unit derived from a monomer represented by following formula (I):

formula (I)

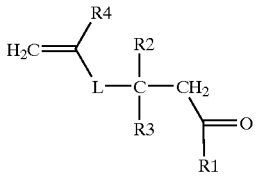

wherein R1 is alkyl, R2 is alkyl or aryl, R3 is hydrogen, alkyl or aryl, L is a linking unit selected from CO—NH, CO—O, and CO, and R4 is hydrogen or alkyl, characterized in that said at least one ink-receiving layer has a porosity higher than 0.1 ml/g of coated solids as measured by gas adsorption(nitrogen) or by mercury diffusion.

11. An ink jet recording material according to claim 10 wherein said polymeric binder is a copolymer of the monomer represented by formula (I) and at least one other monomer selected from the group consisting of vinyl alcohol, vinyl amine, allyl amine, acrylates, methacrylates, acrylamides, methacrylamides, allyl ethers, vinyl ethers, vinyl esters, styrene and styrene derivatives, vinyl acetamide, and vinyl formamide.

12. An ink jet recording material according to claim 10 wherein said monomer according to formula (I) is diacetone acrylamide or diacetone methacryamide, whereby R1, R2, and R3 are methyl, L is CO—NH, and R4 is hydrogen or methyl respectively.

13. An ink jet recording material according to claim 10 wherein said polymeric binder is a copolymer of vinyl alcohol, vinyl acetate and diacetone acrylamide.

14. An ink jet recording material according to claim 10 wherein said polymeric binder is a copolymer of n-butylacrylate and diacetone acrylamide.

15. An ink jet recording material according to claim 10 wherein said pigment is an inorganic pigment.

16. An ink jet recording material according to claim 15 wherein said inorganic pigment is chosen from the group consisting of aluminum oxide, boehmite, pseudoboehmite, gibbsite, bayerite, aluminum hydroxide, silica, clay, calcium carbonate, zirconia, and mixed inorganic oxides/hydroxides.

17. An ink jet recording material according to claim 10 wherein said pigment is smaller than 500 nm.

18. An ink jet recording material according to claim 15 wherein said pigment is smaller than 500 nm.

* * * * *